US010294624B2

(12) United States Patent
Audet

(10) Patent No.: US 10,294,624 B2
(45) Date of Patent: May 21, 2019

(54) VIBRATORY APPARATUS FOR FORCING MEMBERS INTO AND OUT OF A MATERIAL

(71) Applicant: LES PRODUITS GILBERT INC., Roberval (CA)

(72) Inventor: Michel Audet, Terrebonne (CA)

(73) Assignee: LES PRODUITS GILBERT INC., Roberval (Québec) (CA)

( * ) Notice: Subject to any disclaimer, the term of this patent is extended or adjusted under 35 U.S.C. 154(b) by 871 days.

(21) Appl. No.: 14/668,318

(22) Filed: Mar. 25, 2015

(65) Prior Publication Data

US 2015/0275460 A1 Oct. 1, 2015

Related U.S. Application Data

(60) Provisional application No. 61/970,012, filed on Mar. 25, 2014.

(51) Int. Cl.
*E02D 7/18* (2006.01)

(52) U.S. Cl.
CPC ..... *E02D 7/18* (2013.01)

(58) Field of Classification Search
CPC ..... E02D 7/18; E02D 13/00
USPC ..... 173/184; 405/232, 231
See application file for complete search history.

(56) References Cited

U.S. PATENT DOCUMENTS 3,877,743 A * 4/1975 Johnson ..... B66C 3/16 294/106
4,067,369 A * 1/1978 Harmon ..... A01G 23/065 144/24.12
2008/0310923 A1* 12/2008 Jinnings ..... E02D 11/00 405/232
2013/0121771 A1* 5/2013 Kuivamaki ..... E02D 7/18 405/232
2015/0000948 A1* 1/2015 Lindeman ..... E02D 13/00 173/184

FOREIGN PATENT DOCUMENTS

CA 2634402 A1 † 12/2008
WO 9307341 A1 4/1993
WO 0077308 A1 12/2000
WO WO 2013124525 A1 * 8/2013 ..... E02D 7/18

OTHER PUBLICATIONS

Movak TD-700 Tube Driver, was available on Movax Oy's website www.movax.com, at least as early as Aug. 16, 2010.†

* cited by examiner
† cited by third party

*Primary Examiner* — Robert F Long
*Assistant Examiner* — Xavier A Madison
(74) *Attorney, Agent, or Firm* — Baker & Hostetler LLP

(57) ABSTRACT

A vibratory apparatus providing increased vibration of members held for penetrating a material with the member, by holding the members directly against the vibrating unit using the jaws, thus providing a greater amount of vibration directly transferred to the members for penetrating the material therewith while losing less energy. The apparatus can hold cylindrically shaped members at three separate points of contact or gripping positions for improved, more stable and secure holding thereof. The apparatus can be used to force a variety of different types of members into and out of the material, with or without the use of adaptor attachment components.

18 Claims, 17 Drawing Sheets

VIBRATORY APPARATUS FOR FORCING MEMBERS INTO AND OUT OF A MATERIAL

FIELD OF THE INVENTION

The present invention relates to an apparatus for forcing members into and out of a material, and is more particularly directed to a vibratory apparatus for forcing members into and out of a material.

BACKGROUND

Use of vibratory apparatuses for forcing members into and out of the ground is well known in the art. For example, international patent application publication No. WO00/77308 filed by Expotech Limited on Jun. 12, 2000 and international patent application publication No. WO93/07341, filed by Raunisto on Sep. 30, 1992, both teach vibratory apparatuses suitable for connection to movable device arms of a driving or positioning device, such as the articulated arms found on booms, excavators or many other construction devices. Such apparatuses typically include jaws or grips for retaining the members, for example piles or the like therebetween. A vibration means connected to the jaws causes vibration of the jaws, which transfer the vibration to the members held therebetween. A conventional hinge attachment, well known in the art, having a hinge and a tilting hydraulic piston and cylinder combination connects the apparatus to the device arms, and provides lateral or sideways tilting of the apparatus and the members in the jaws relative the device arms. The hinge attachment may be connected to a housing for the jaws or vibration means. Alternatively, the hinge attachment may be connected to a rotator means, such as a motorized rotation means, well known in the art, connected to the housing or vibrator means, in which case the jaws and vibrator means are also rotatable around an axis defined by the rotatable cylinder. By use of the device arms, the apparatus, and notably the members, can be raised and lowered proximal a work surface or material, for example a cement or ground surface. The vibrator means connected to the jaws causes the members to vibrate and enables the members to penetrate the material or surface, allowing the members to be forced into or withdrawn from the material or surface. The members may be of any type, but are typically members used for construction and excavation work, such as round pipes, pipes, logs, planks, or H-shaped metal beams.

Disadvantageously, such conventional apparatuses, specifically the jaws thereof, are poorly adapted to retaining round members, such as pipes, or wooden logs often used therewith. Thus, the conventional apparatuses present a risk that the members may break or become dislodged from the jaws during application of the member to the material. Further, for conventional apparatuses, the vibrator means does not contact directly contact any of the members, and the vibration generated by the vibrator means is therefore applied only indirectly via the jaws. Accordingly, significant amounts of energy are expended, unnecessarily, to obtain sufficient vibration of the members to break or penetrate the work surface or material.

Accordingly, there is a need for an improved vibratory apparatus for forcing members into and out of a material.

SUMMARY

It is therefore a general object of the present invention to provide an improved vibratory apparatus for forcing members into and out of a material.

An advantage of the present invention is that the apparatus provides increased vibration of members held for penetrating the material with the member, by holding the members directly against the vibrating unit using the jaws.

Another advantage of the present invention is that the apparatus provides a greater amount of vibration directly transferred to the members for penetrating the material therewith while losing less energy.

A further advantage of the present invention is that the apparatus can hold cylindrically shaped members at three separate points of contact or gripping positions for improved, more stable and secure holding thereof.

Still another advantage of the present invention is that the risk of breakage of the members or accidental disconnection of the members from the apparatus is reduced.

Yet another advantage of the present invention is that the apparatus can be used to force a variety of different types of members into and out of the material, with or without the use of adaptor attachment components.

According to a first aspect of the present invention, there is provided a vibratory apparatus for forcing members into and out of a material and for use with a device having at least one movable device arm movable towards and away from the material, the apparatus comprising:

an outer housing connected to the device arms;

a vibratable inner housing mounted in the outer housing and extending outwardly therefrom; and first and second outer jaws and an intermediate jaw, the outer jaws and the intermediate jaw being pivotally connected to the inner housing proximal opposed side walls thereof with the outer jaws and the intermediate jaw extending towards one another, the outer jaws and the intermediate jaw being configured for pivotal movement towards and away from each other for holding at least one member therebetween and in abutment therewith, the inner housing being selectively vibratable to cause the member to vibrate by abutment therewith and through contact with the outer and intermediate jaws to force the member into or out of the material.

In an embodiment, the first outer, second outer and intermediate jaws have curved inner jaw walls, and preferably tapering down towards a respective gripping end thereof.

In another embodiment, the apparatus further includes a first removable gripping attachment extending between tips of the first and second outer jaws.

In another embodiment, the apparatus further includes a second removable gripping attachment extending along a tip of the intermediate jaw.

In another embodiment, to enhance the controlled movement of the jaws, the first and second outer jaws are pivotable about a common outer jaw axle, the intermediate jaw is pivotable about an intermediate jaw axle, the intermediate jaw axle being positioned between the outer jaw axle and an outer extremity of the outer jaws, the apparatus further includes a cross-arm axle extending through the first and second outer jaws, and the cross-arm axle is connected by at least one cross arm to the intermediate jaw axle.

Some objects, advantages and other features will become more apparent upon reading the following non-restrictive description of certain optional configurations, given for the purpose of exemplification only, with reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION

Figure 1:
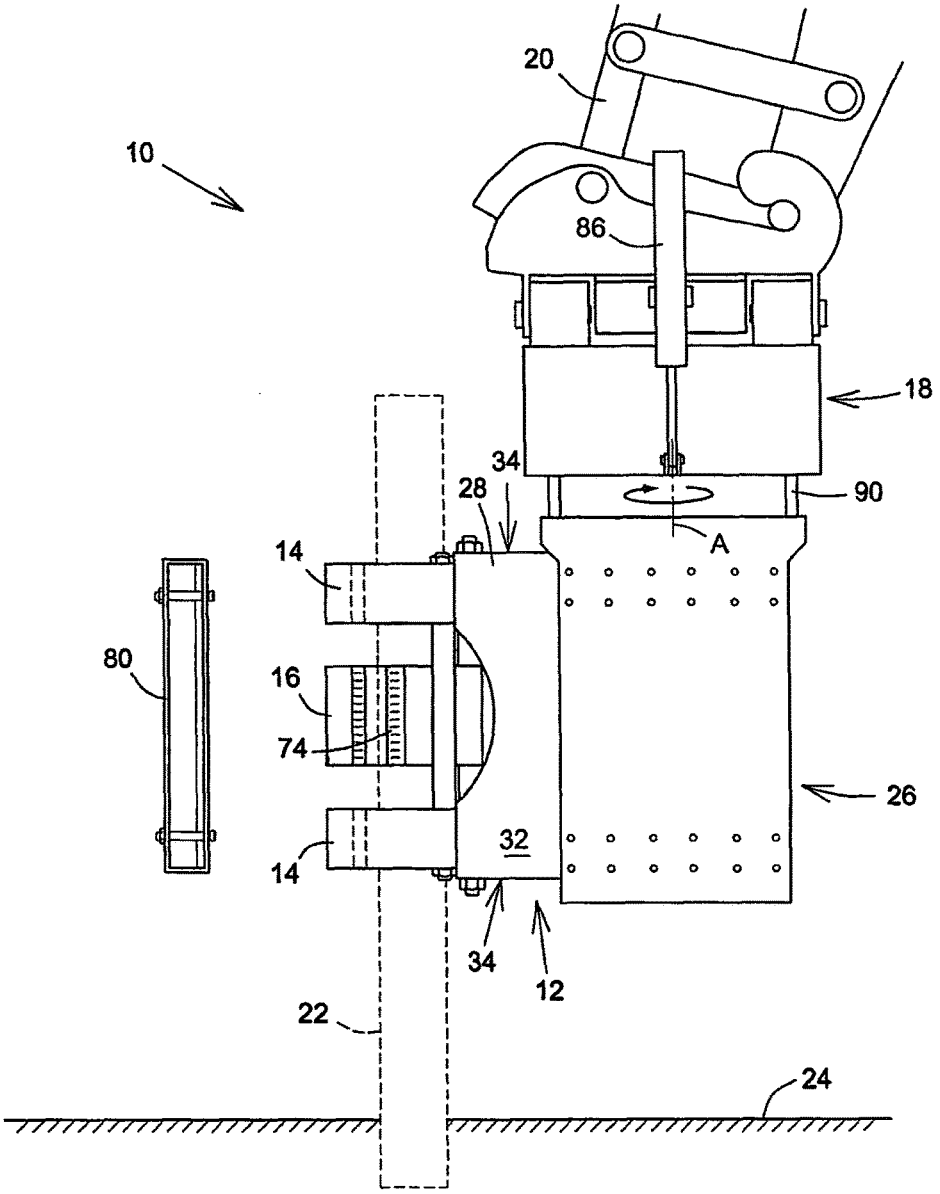
FIG. 1 is a side view of a vibratory apparatus for forcing members into and out of a material, in accordance with a first embodiment of the present invention.
Figure 1A:
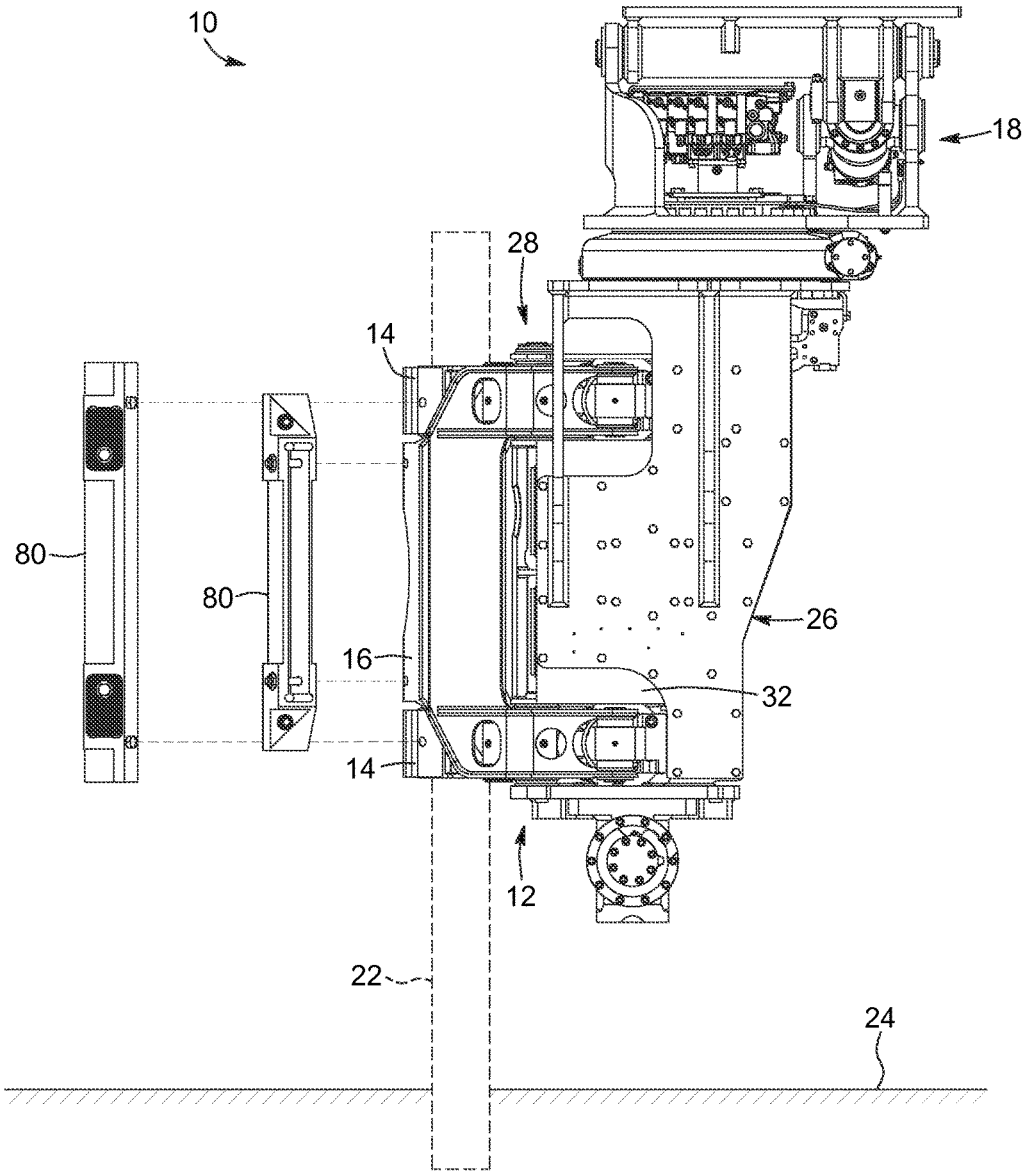
FIG. 1A is a side view of a vibratory apparatus for forcing members into and out of a material, in accordance with a another embodiment of the present invention.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the present invention may be used with a vibratory apparatus, for example, it is understood that it may be used with other types of vibratory apparatuses, for other purposes. For this reason, expressions such as "vibratory apparatus", "construction and excavation work", etc. as used herein should not be taken as to limit the scope of the present invention to being used with a vibratory apparatus in particular. These expressions encompass all other kinds of materials, objects and/or purposes with other types of vibratory apparatuses with which the present invention could be used and may be useful.

In addition, although the optional configurations as illustrated in the accompanying drawings comprises various components and although the optional configurations of the vibratory apparatus as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the vibratory apparatus, and corresponding parts, as briefly explained and as can be easily inferred herefrom, without departing from the scope of the disclosure.

Referring to FIGS. 1 and 3 to 6, according to an embodiment of the present invention, there is shown a vibratory apparatus 10 for forcing members, for example cylindrical members 22 or H-shaped members 22', into and out of a surface or material 24.

As best shown in FIGS. 1, 2, 6, and 6*a*, the apparatus 10 includes an outer housing 26, a vibratable inner housing 12 for providing vibrations, first and second outer jaws 14 and an intermediate jaw 16 pivotally connected to the vibratable inner housing 12. A connection assembly 18 provides connection of the apparatus 10, notably the outer housing 26, to a preferably articulated device arm 20 of a, preferably hydraulic, driving or positioning device, not shown, such as a conventional hydraulic boom, excavator, or other construction device. The jaws 14, 16 are configured such that a cylindrically shaped member 22, for example a log, pipe, or pile, may be gripped therebetween and held in abutment with the jaws 14, 16 and the vibratable inner housing 12. The vibration provided by the vibratable inner housing 12 is transmitted to the cylindrical member 22 not only through the jaws 14, 16, as is well known in the art, but also directly to the member 22 in contact with the inner housing 12. Accordingly, the apparatus 10 provides improved transmission of the vibration to the cylindrical member 22 and enables the member 22 to be forced into and out of a material 24, for example the ground 24, with less effort and energy. The vibratable inner housing 12 is selectively vibratable by activation of a conventional vibratory force generator, not shown, connected thereto. The vibratory force generator is preferably based on a hydraulic motor, well known in the art, but may any type of vibratory force generator known in the art provided sufficient vibratory force to penetrate the material 24 may be generated thereby.

Figure 6:
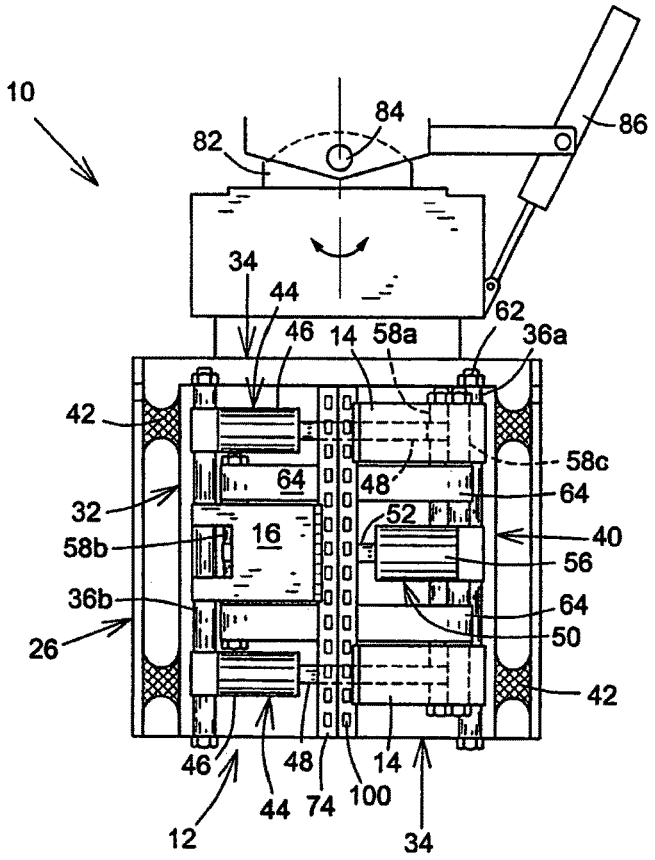
FIG. 6 is a front sectional view of the apparatus shown in FIG. 1.
Figure 6A:
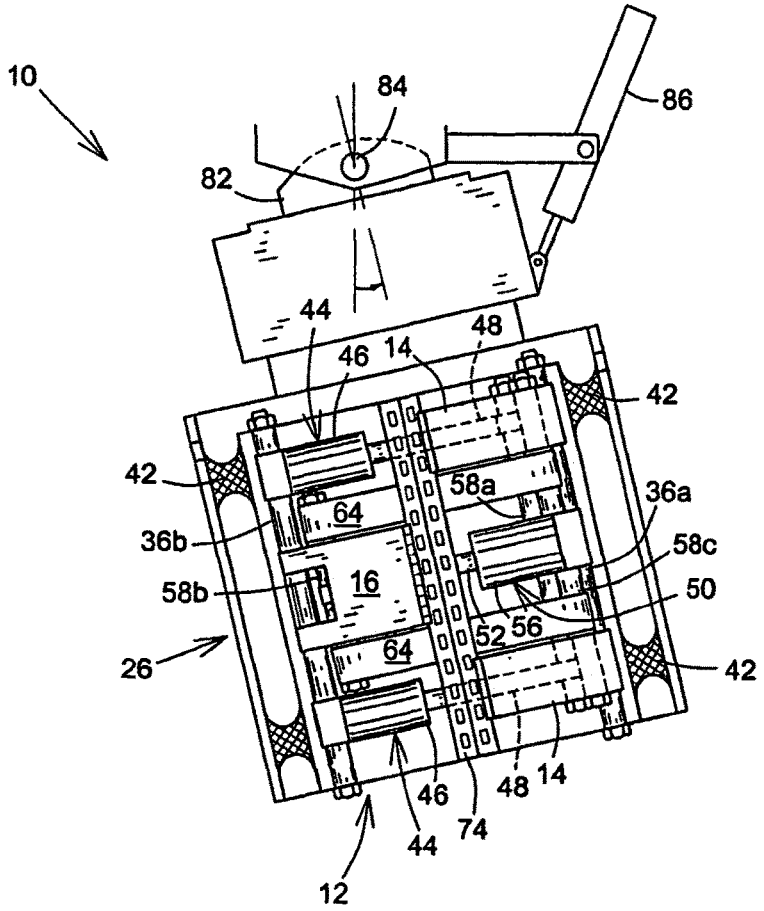
FIG. 6*a* is a front sectional view of the apparatus shown in FIG. 1, illustrating tilting of the apparatus relative a device arm to which the apparatus is connectable.
Figure 6B:
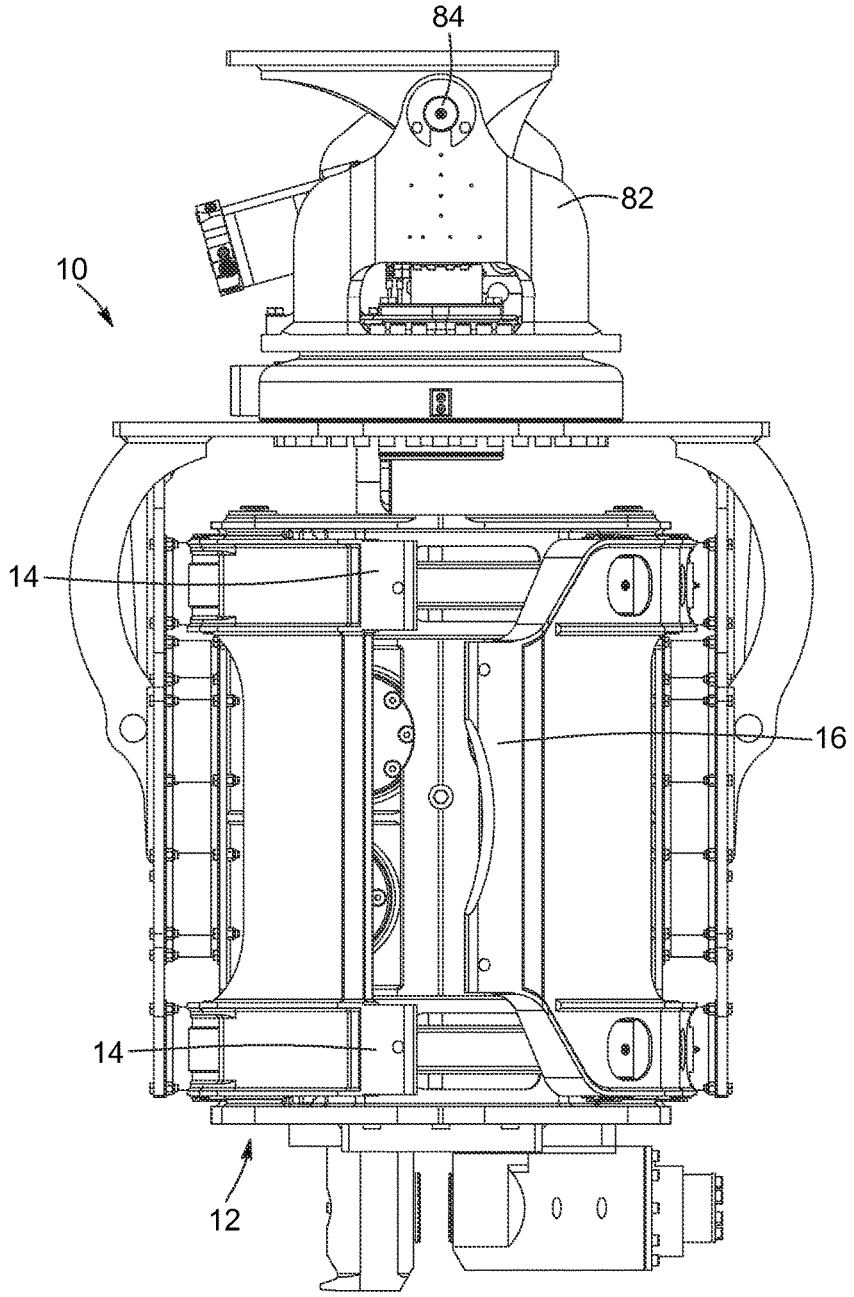
FIG. 6B is a front view of the apparatus shown in FIG. 1A, without a gripping attachment.
Figure 6C:
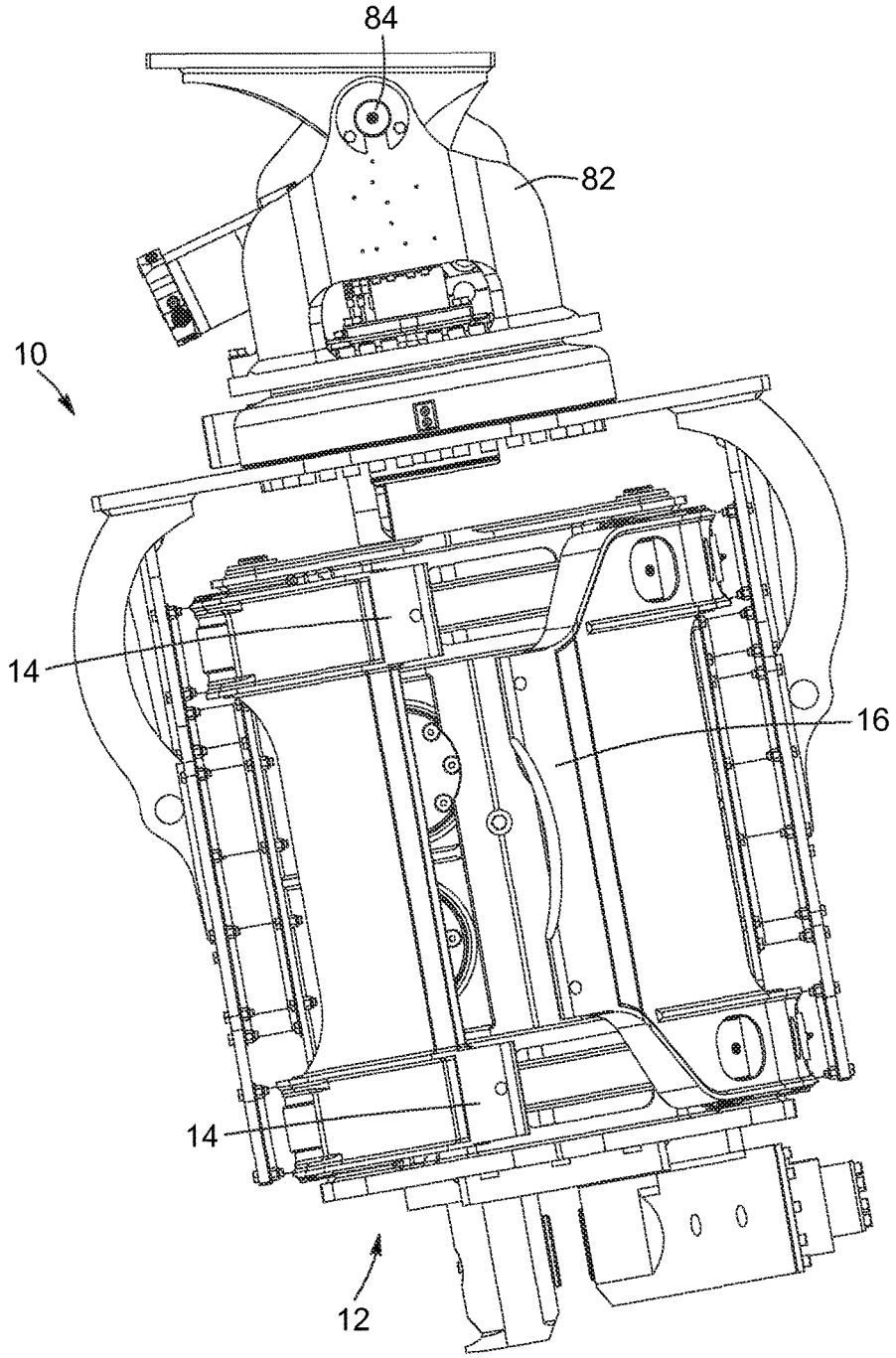
FIG. 6C is a front view of the apparatus shown in FIG. 1A, without a gripping attachment, illustrating tilting of the apparatus relative a device arm to which the apparatus is connectable.
Figure 7:
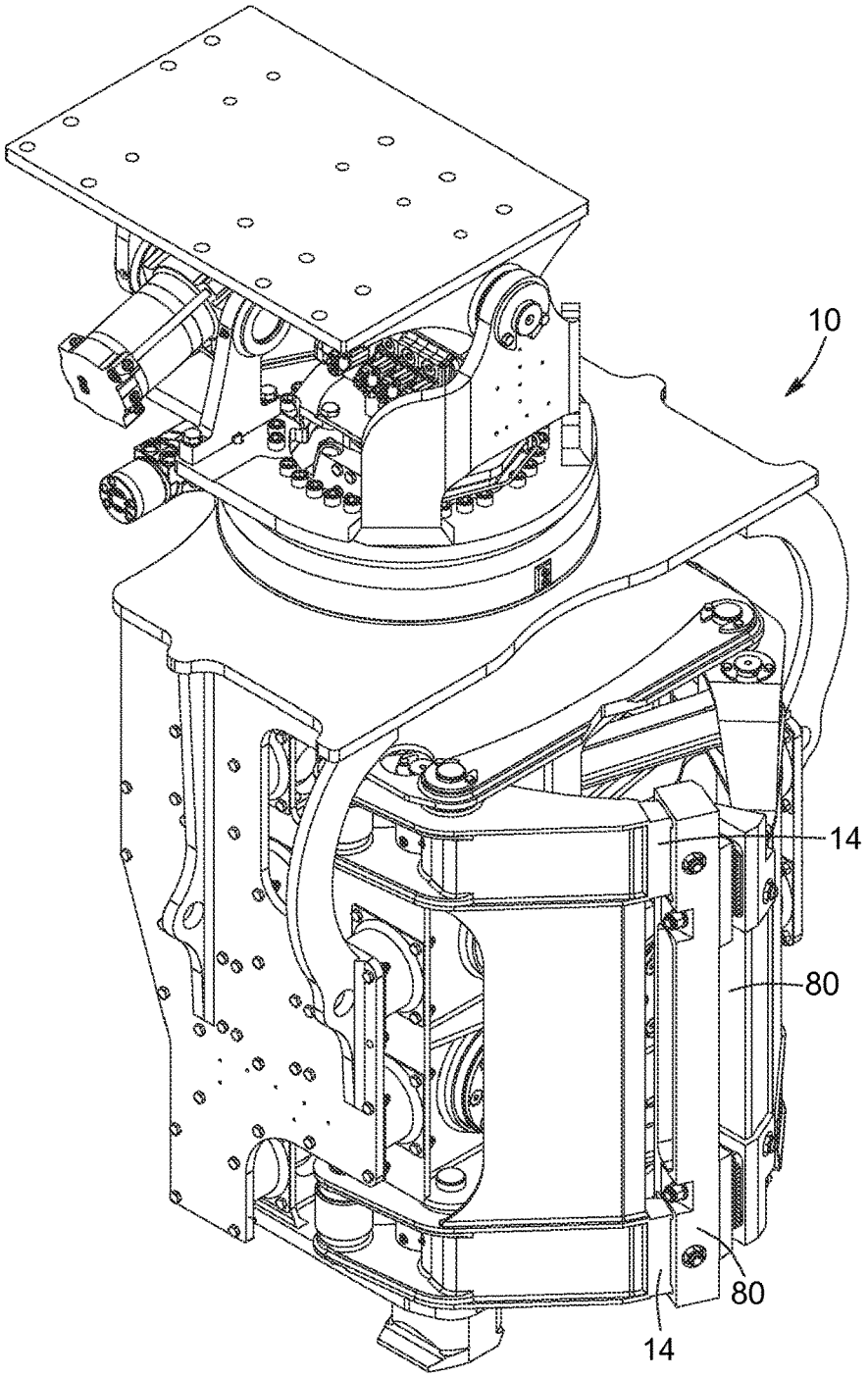
FIG. 7 is a perspective view of the apparatus shown in FIG. 1A, with a gripping attachment.
Figure 8:
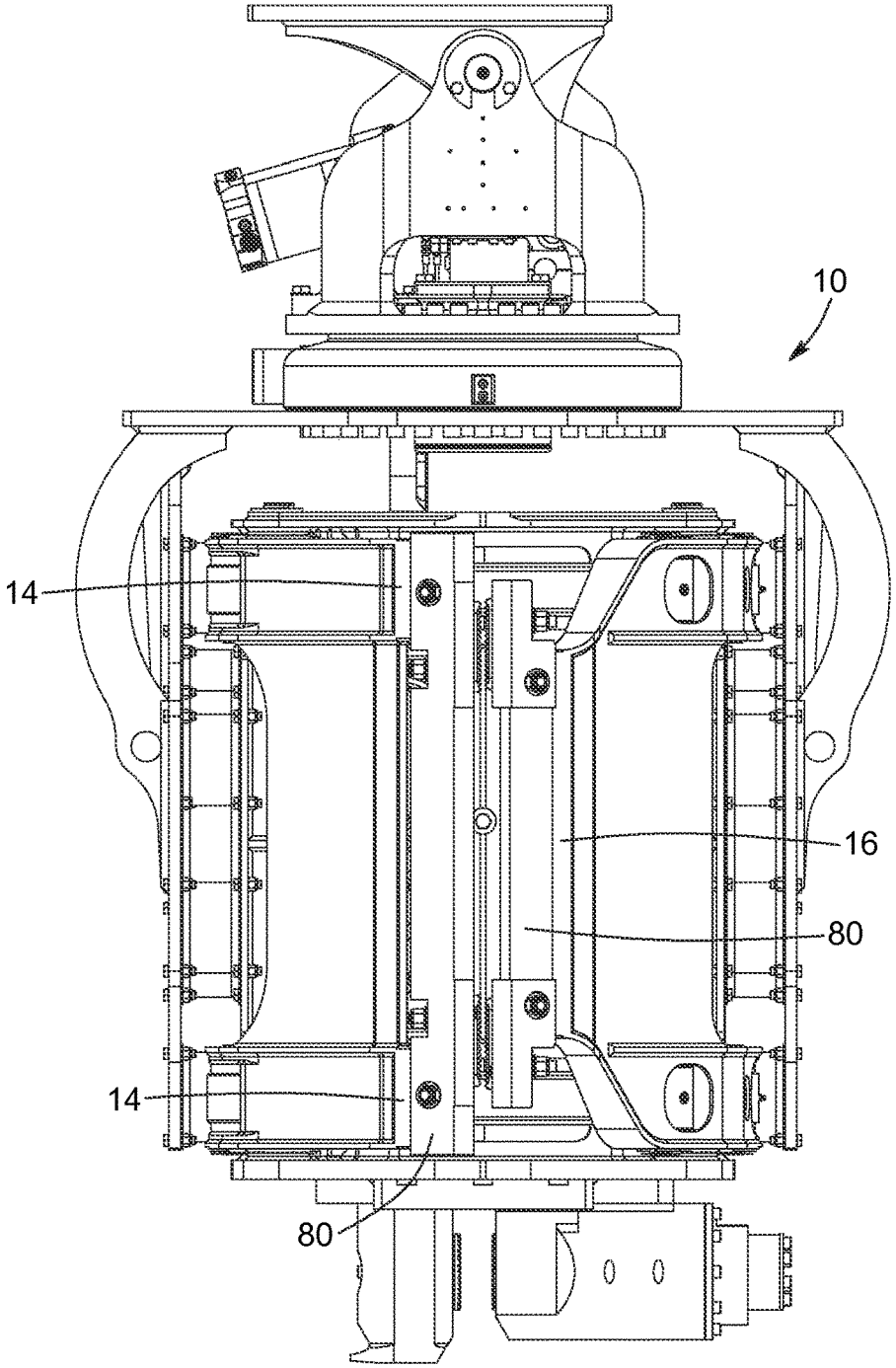
FIG. 8 is a front view of the apparatus shown in FIG. 7.
Figure 9:
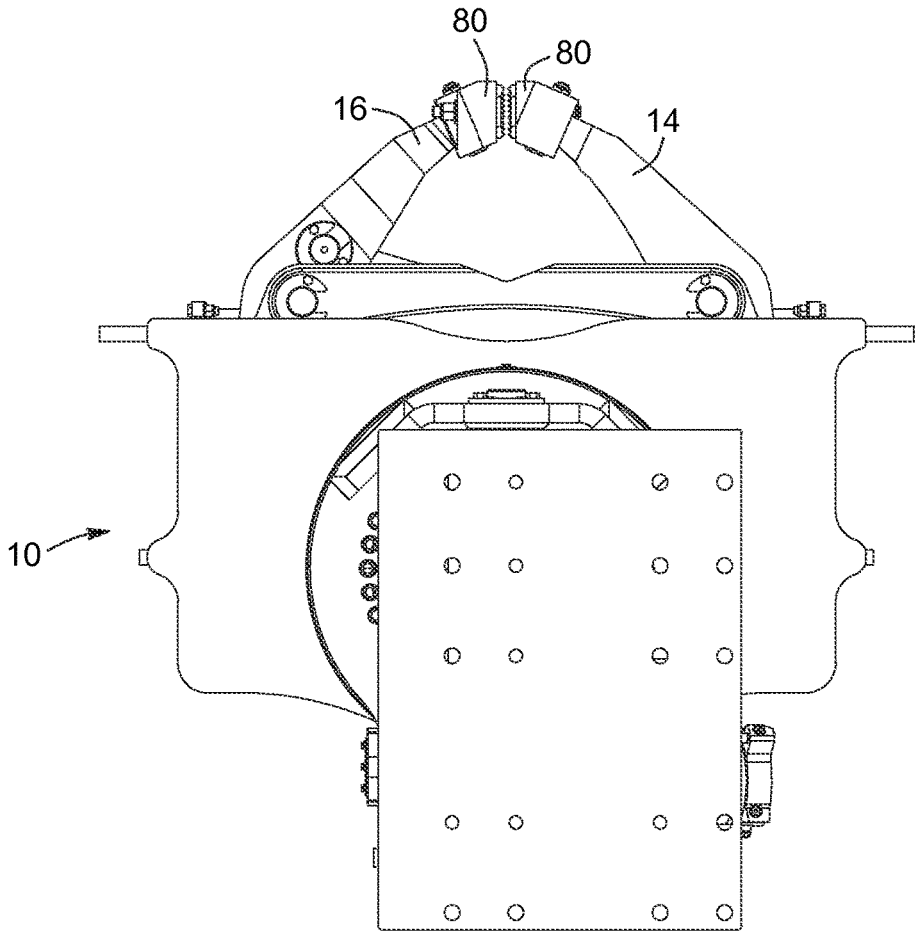
FIG. 9 is a top view of the apparatus shown in FIG. 7.
Figure 10:
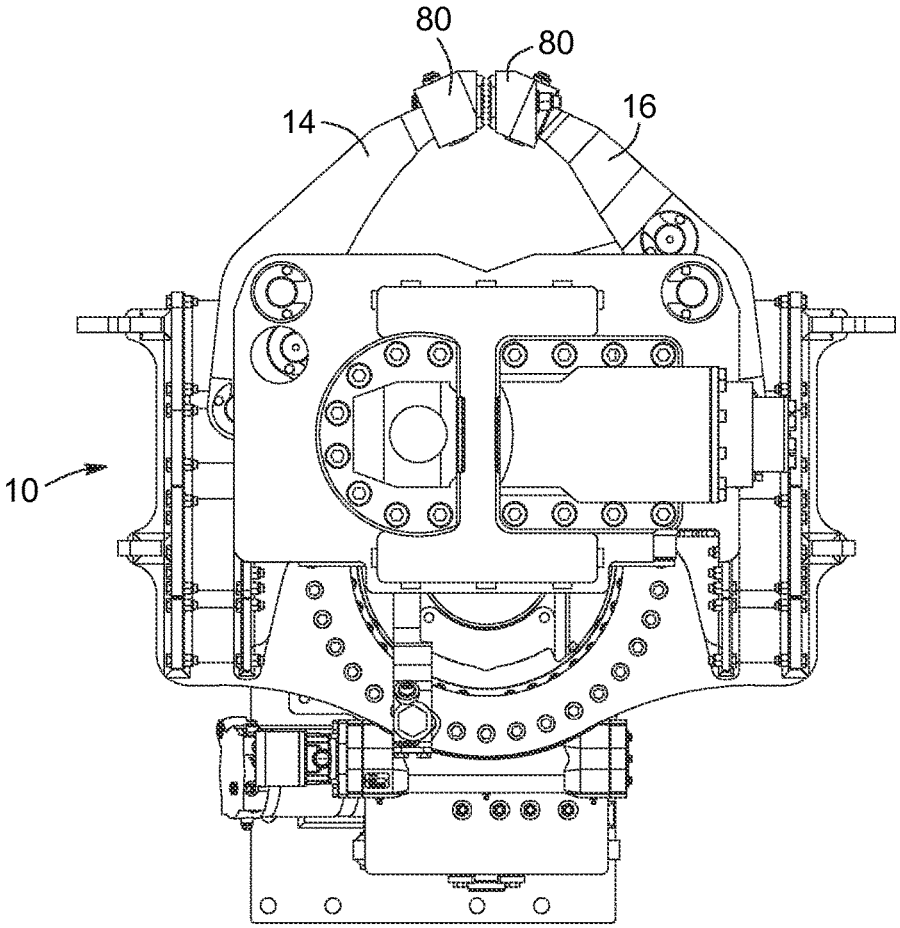
FIG. 10 is a bottom view of the apparatus shown in FIG. 7.
Figure 11:
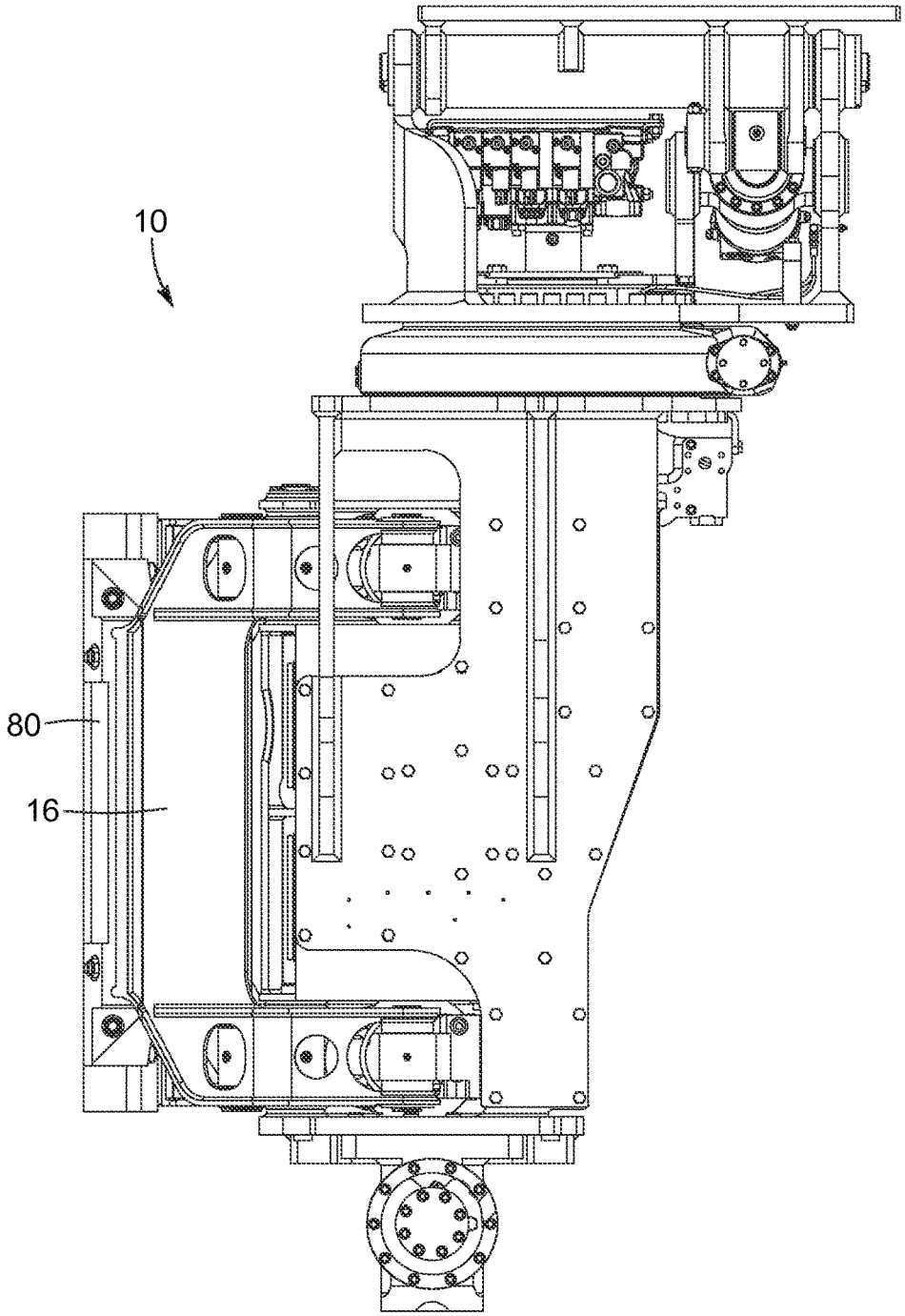
FIG. 11 is a side view of the apparatus shown in FIG. 7.
Figure 12:
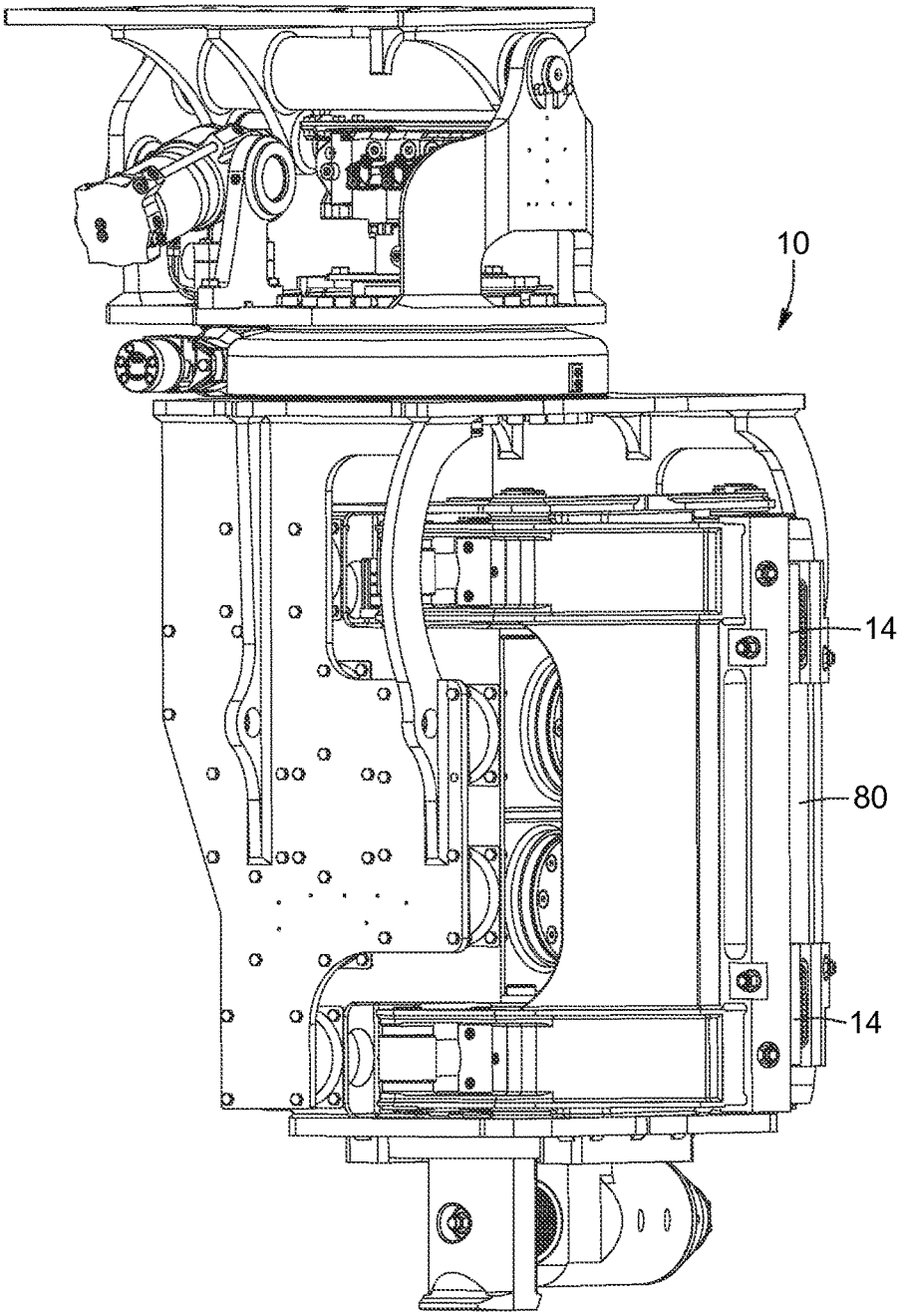
FIG. 12 is an opposite side view of the apparatus shown in FIG. 7.
Figure 13:
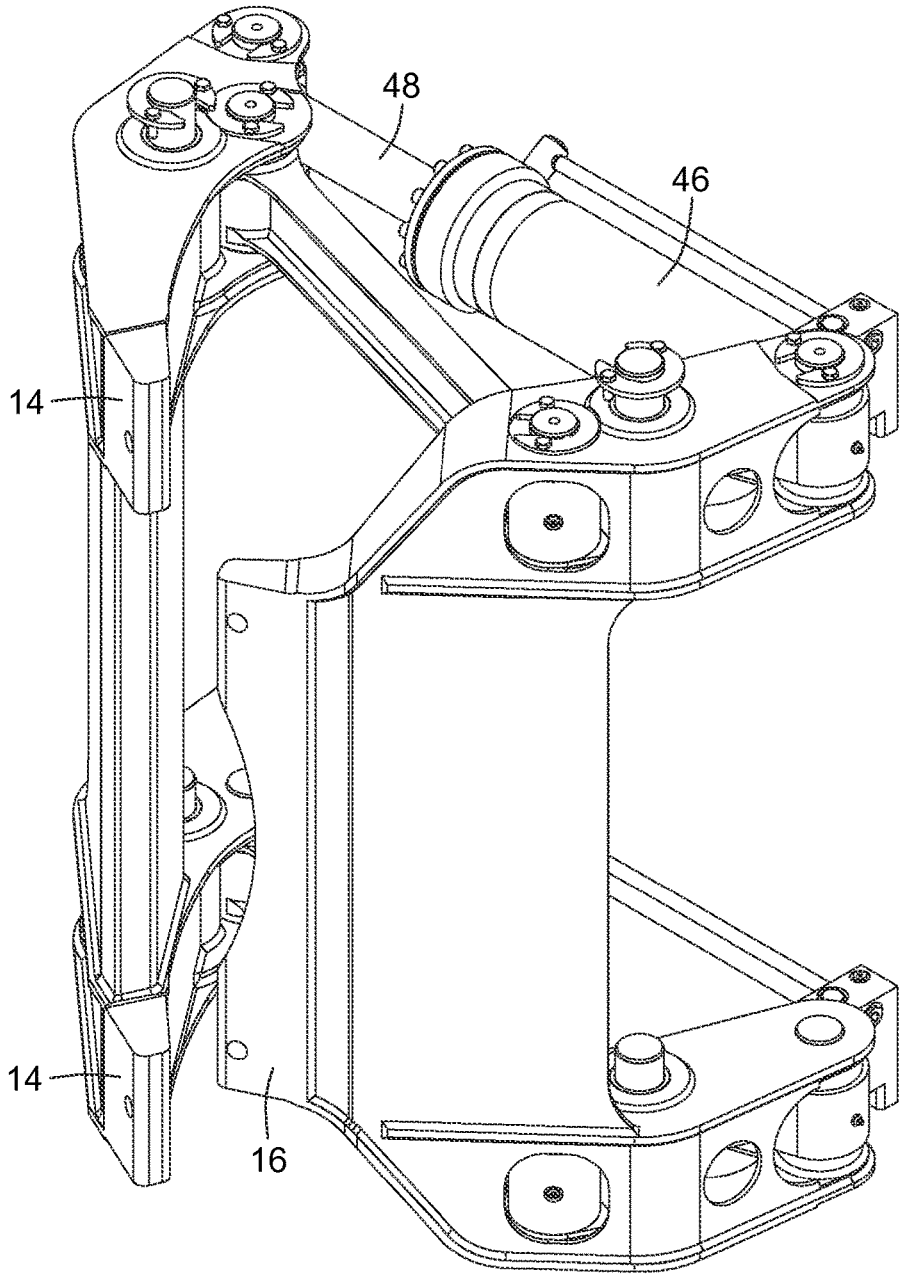
FIG. 13 is a front perspective view of the outer jaws and the intermediate jaw of the apparatus shown in FIG. 7.
Figure 14:
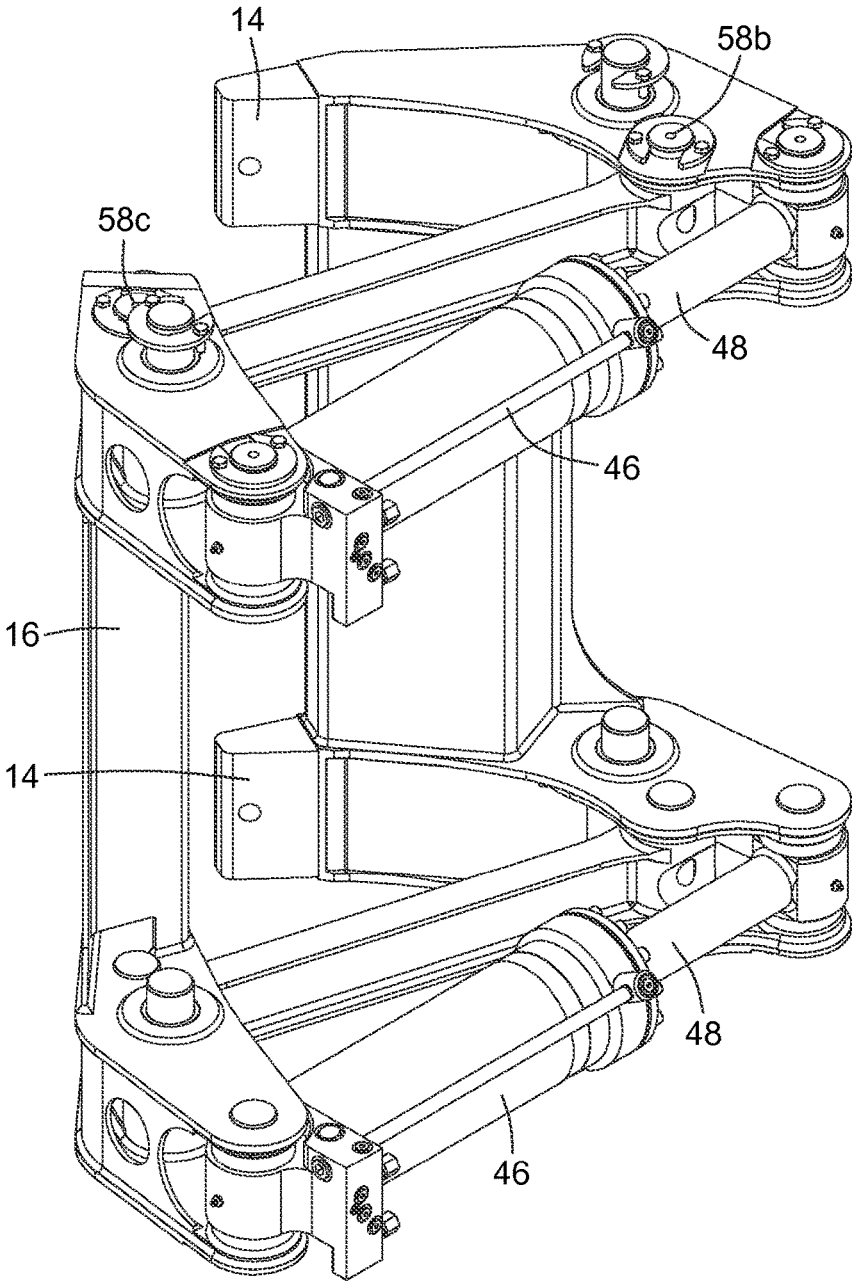
FIG. 14 is a rear perspective view of the outer jaws and the intermediate jaw of the apparatus shown in FIG. 7.

Referring now to FIGS. 1, 6, and 6*a*, the outer housing 26 extends below the connection assembly 18 and device arm 20. The inner housing 12 is securely mounted in the outer housing 26 and has an end portion 28 extending outwardly therefrom, preferably substantially perpendicular or radially relative the device arm 20 and connection assembly 18. Within the outer housing 26, insulating rubber or foam insulating bands 42 extend from the inner side walls 40 of the outer housing 26 to the side walls 32 of the inner housing 12 to reduce vibration of the outer housing 26. Optionally, there may also be insulating bands extending between the top and bottom walls 34 of the inner housing 12 and the outer housing 26.

Referring now to FIGS. 1, 2, 6, and 6*a*, the end portion 28 provides a jaw mounting bracket, in which jaws 14, 16 are pivotally mounted. More specifically, the mounting bracket is formed, on the end portion 28, by the generally opposed horizontally extending top and bottom walls 34 of the inner housing 12 connected by the first and second side walls 32*a*, 32*b* of the inner housing 12. First and second outer jaws 14 are coaxially and pivotally mounted, proximal inner jaw ends 54*a*, on a first axle or shaft 36*a* which extends from the top wall 34 to the bottom wall 34 proximal first side wall 32*a*. The intermediate jaw 16 is mounted, proximal inner jaw end 54*b*, on a second axle or shaft 36*b* which extends from the top wall 34 to the bottom wall 34 proximal second side wall 32*b*.

The outer jaws 14 are pivoted back and forth, i.e. away from and towards the centre of the mounting bracket and the intermediate jaw 16, by outer hydraulic rams 44, one for each outer jaw 14. The outer cylinder 46 for each outer hydraulic ram 44 is, preferably rotatably, mounted on the second shaft 36*b* with the outer ram shaft 48 connected to axle 58*a* mounted, preferably rotatably, through first and second jaws 14 proximally adjacent inner jaw ends 54*a*. The intermediate jaw 16 is pivoted back and forth, i.e. away from and towards the centre of the mounting bracket and the outer jaws 14, by intermediate hydraulic ram 50. The intermediate cylinder 56 for the intermediate hydraulic ram 50 is, preferably rotatably, mounted on the first shaft 36*a* with the intermediate ram shaft 52 connected to axle 58*b* mounted, preferably rotatably, through the intermediate jaw 16 proximally adjacent inner jaw end 54*b*. The shafts 36 and axles 58 are secured by nuts 62, as is well known in the art. As the hydraulic rams 44, 50 selectively extend and retract ram shafts 48, 52, the inner ends 54 connected to axles 58*a*, 58*b* are, respectively, moved outwardly and inwardly by pivoting of jaws 14, 16 on shafts 36. Accordingly, as the hydraulic rams 44, 50 selectively extend and retract ram shafts 48, 52, the tapered jaw tips 60, or gripping ends, generally opposite jaw ends 54 move, respectively, towards and away from one another to, respectively, close and open jaws 14, 16 relative one another.

The rams 44, 50 are configured to hydraulically (all connected in parallel) move jaws 14, 16 simultaneously during opening and closing thereof. However, to physically enhance the mechanical synchronization device controlling movements of jaws 14, 16, an additional cross-arm axle 58*c* extending through outer jaws 14 relatively proximal the tips thereof 60 compared to shaft 36*a* and axle 58*a*, is connected by cross arms 64 to axle 58*b* for the intermediate jaw 16. Thus, as soon as the outer jaws 14 begin to pivot, the cross arms 64 cause the intermediate jaw 16 to pivot as well, and vice-versa. For additional security, the cylinders 46, 56 may be equipped with an anti-slip or locking valve, well known in the art, which prevents unwanted backward movement and release of the members 22, 22'.

Figure 2:
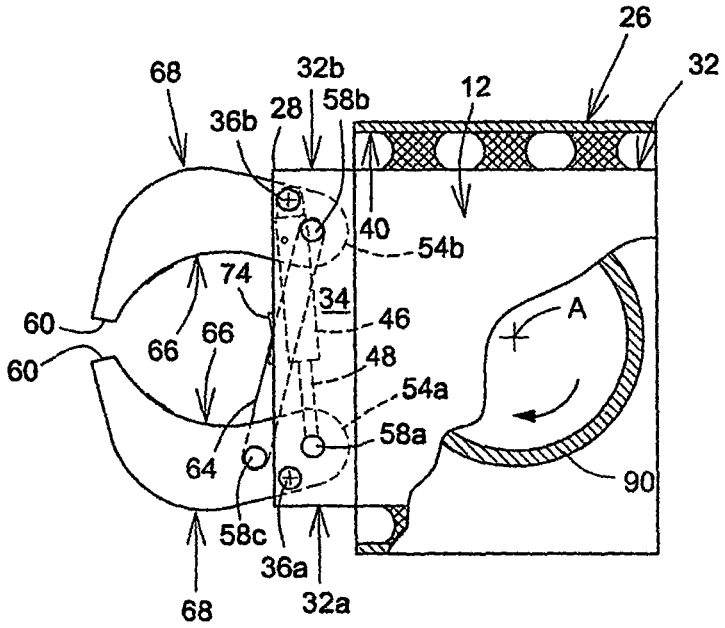
FIG. 2 is a partially cross-sectional top view of the apparatus shown in FIG. 1.
Figure 3:
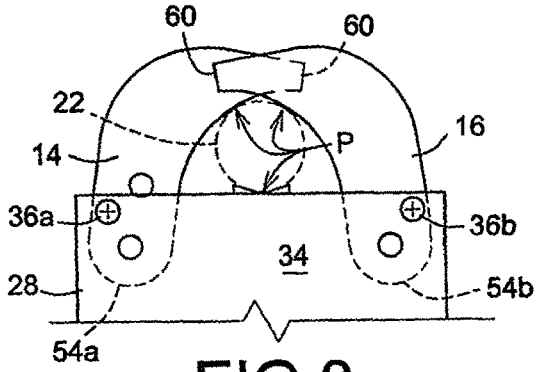
FIG. 3 is a top view of the apparatus shown in FIG. 1, showing a single cylindrical member held in the jaws of the apparatus.
Figure 5:
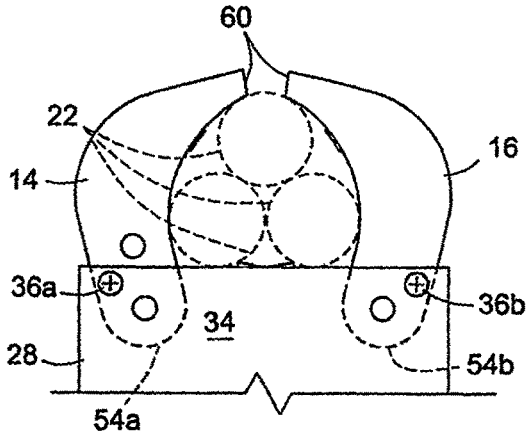
FIG. 5 is a top view of an apparatus shown in FIG. 1, showing a plurality of cylindrical members held in jaws of the apparatus.
Figure 3A:
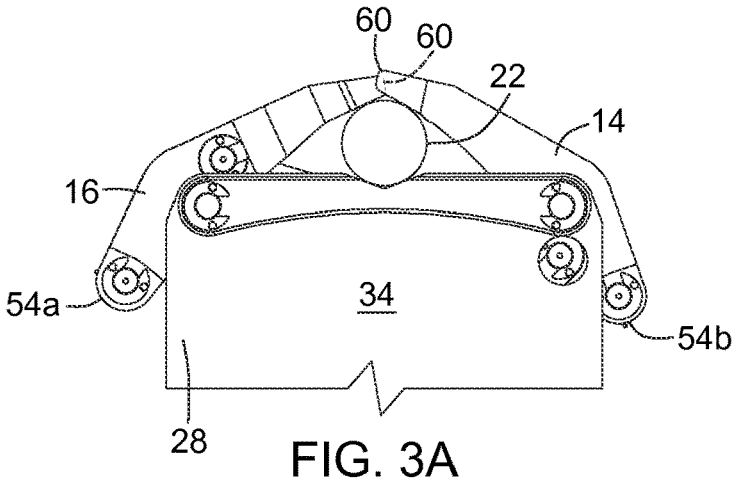
FIG. 3A is a partially cross-sectional top view of the apparatus shown in FIG. 1A, showing a single cylindrical member held in the jaws of the apparatus.
Figure 4A:
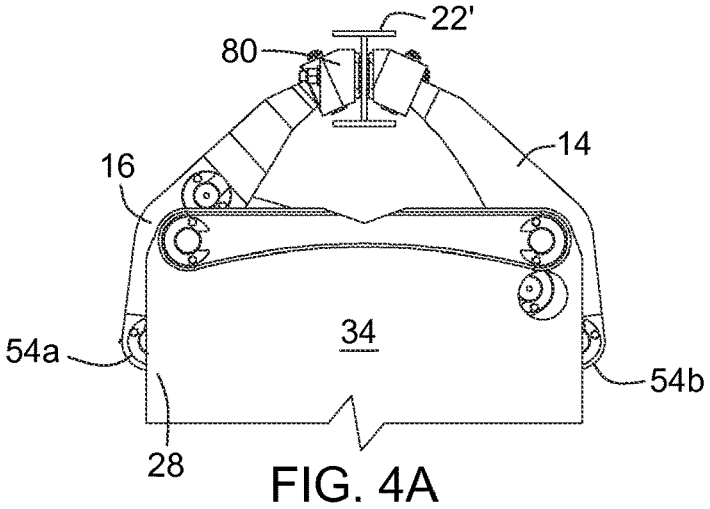
FIG. 4A is a partially cross-sectional top view of the apparatus show in FIG. 1A, showing an H shaped member held in jaws of the apparatus.
Figure 5A:
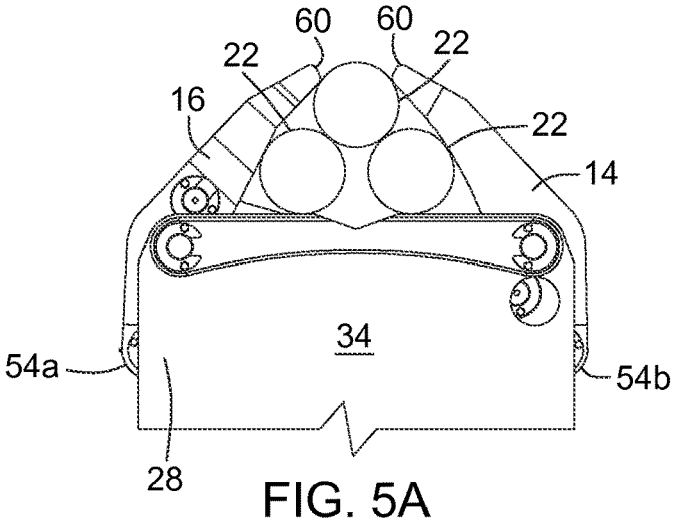
FIG. 5A is a partially cross-sectional top view of an apparatus shown in FIG. 1A, showing a plurality of cylindrical members held in jaws of the apparatus.

Referring now to FIGS. 2, 3, and 5, the jaws have curved inner jaw walls 66 10 and, preferably, curved outer jaw walls 68 and are sized and shaped such that, when the jaw tips 60 are drawn towards one another during closing of the jaws 14, 16, the tips of the outer jaws 14 can overlap the jaw tip 60 of the intermediate jaw 16, as shown in FIG. 3. Further, the jaw walls 66, 68 preferably taper towards one another towards the jaw tips 60. As shown in FIG. 5, the curved inner walls 66 of jaws 14, 16 allow, not just one, but multiple cylindrical members 22, generally organized in a triangular structure, to be held therebetween, for handling of these members 22. Accordingly, as shown in FIG. 3, when only one member 22 is held within the jaws 14, 16 and in abutment with the vibratable inner housing 12, the vibration is passed directly from the inner housing to the cylindrical members 22 abutting therewith, in addition to the jaws 14, 16 connected to the inner housing 12. Thus, the advantages of the apparatus 10, in terms of maximizing use of the vibrations provided by the vibratable inner housing 12 and vibratory force generator are conserved. Further, the curved inner walls 66 and tapered form of the jaws 14, 16, as well as the capability of overlapping the tips 60, ensures that the jaws 14, 16 can safely grip a wide variety of sizes of cylindrical members 22. The curved inner walls 66 and tapered form of the jaws 14, 16 also ensure that the jaws 14, 16 and inner housing 12 can abut the cylindrical members 22 held therebetween at three gripping positions P, thus ensuring superior transmission of vibration and reducing risk of slippage of the members 22, 22'. To further reduce this risk, hard metal tracks or guides 74 may be deployed at gripping positions P, and notably equidistant the side walls 32, to provide additional traction and reduce risk of slippage. The tracks 74, made of a hard metal, covered with a hard facing welded onto it, preferably have carbide bits 100 or hard facing, extending therealong to provide additional grip and prevent sliding. Such carbide bits 100 can also be located at the tip 60 of the intermediate jaw 16 as well as along the gripping surface of the gripping attachment 80 (described herein below).

Figure 4:
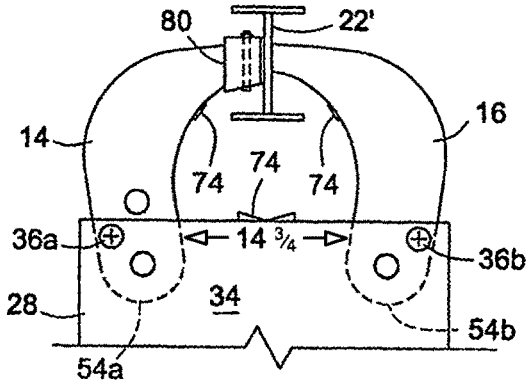
FIG. 4 is a top view of the apparatus show in FIG. 1, showing an H shaped member held in jaws of the apparatus.

Referring now to FIGS. 1 and 4, and more specifically as shown in FIG. 4, the jaw tips 60 are preferably sized and shaped such that they may fit within the grooves of an H shaped member 22', such as conventional H beam 22' or any other flat surfaced members. Thus, by attaching a longitudinal gripping attachment 80 or adaptor piece to the tips 60 of the outer jaws 14, with the attachment extending therebetween, the jaws 14, 16 may be closed such that the tip 60 of the intermediate jaw 16 and the gripping attachment 80 on the outer jaws 14 securely retain the H beam 22'. A second removable gripping attachment can be provided along the tip of the intermediate jaw 16 to reduce any wear due to repeated contact with the members 22'. Thus, the apparatus can be used to force the H Beam 22', vibrated by the vibration form the inner housing 12 passed through the jaws 14, 16, into and out of the material 24. Changeout of the gripping attachment 80 can be accomplished quickly for different applications within minutes. For example, the gripping attachment can be modified in order to use the vibratory apparatus with sheet piles instead of H-beams.

The jaws 14, 16 are also preferably generally "J-shaped", instead of most prior art "C-shaped" jaws, to allow manipulation of cylindrical members ranging, for example, between 4" and 12" in diameter, without changing out equipment. However, the J-shape requires three gripping points, instead of two for a prior-art C-shaped jaw pair.

As shown in FIGS. 1, 6, and 6*a*, the connection assembly 18 typically includes a conventional hinge attachment 82, enabling attachment of the apparatus 10 to the device arm 20 apparatus using pins or rods 84, as is well known in the art for conventional rapid attachment systems for hydraulic arms 20 of booms or excavators. A hydraulic ram 86 of the connection assembly 18 connects the apparatus 10 to the device arms 20, and provides lateral or sideways tilting of the apparatus 10 and jaws 14, 16 relative the device arm 20. The connection assembly 18 can also include a motorized rotation device 90, such as a motorized rotatable drum 90, well known in the art, connected to the outer housing 26 and hinge attachment 82. In such case, the jaws 14, 16 and housings 12, 26 are rotatable around an axis A defined by the rotatable drum 90.

FIGS. 1A, 3A to 5A, 6B-6C and 7 to 14 illustrate another embodiment of the present invention including the arrangement of components that are described above in relation to FIGS. 1 and 3 to 6.

Of course, numerous modifications could be made to the above-described configurations without departing from the scope of the disclosure.

The invention claimed is:

1. A vibratory apparatus for forcing members into and out of a material and for use with a device having at least one movable device arm movable towards and away from the material, the apparatus comprising:

an outer housing connected to the device arms;

a vibratable inner housing mounted in the outer housing and extending outwardly therefrom; and first and second outer jaws and an intermediate jaw, the outer jaws and the intermediate jaw being pivotally connected to the inner housing proximal opposed first and second side walls thereof, the outer jaws and the intermediate jaw being configured for pivotal movement towards and away from each other for holding at least one member therebetween and in abutment therewith, the outer jaws being spaced apart along the first side wall and having respective outer jaw tips defining a gap therebetween, the intermediate jaw being connected proximate the second side wall opposite the gap and having an intermediate jaw tip reaching within the gap when the jaws are pivoted towards each other, the vibratory apparatus comprising a longitudinal gripping attachment removably connected to the outer jaw tips so as to extend within said gap, the inner housing being selectively vibratable to cause the member to vibrate by abutment therewith and through contact with the outer and intermediate jaws to force the member into or out of the material.

2. The vibratory apparatus according to claim 1, wherein the first outer, second outer and intermediate jaws have curved inner jaw walls.

3. The vibratory apparatus according to claim 1, wherein each of the first outer, second outer and intermediate jaws taper down towards a respective gripping end thereof.

4. The vibratory apparatus according to claim 2, wherein each of the first outer, second outer and intermediate jaws taper down towards a respective gripping end thereof.

5. The vibratory apparatus according to claim 1, wherein the at least one gripping attachment includes a first removable gripping attachment extending between tips of the first and second outer jaws.

6. The vibratory apparatus according to claim 2, wherein the at least one gripping attachment includes a first removable gripping attachment extending between tips of the first and second outer jaws.

7. The vibratory apparatus according to claim 3, wherein the at least one gripping attachment includes a first removable gripping attachment extending between tips of the first and second outer jaws.

8. The vibratory apparatus according to claim 4, wherein the at least one gripping attachment includes a first removable gripping attachment extending between tips of the first and second outer jaws.

9. The vibratory apparatus according to claim 5, wherein the at least one gripping attachment further includes a second removable gripping attachment extending along a tip of the intermediate jaw.

10. The vibratory apparatus according to claim 6, wherein the at least one gripping attachment further includes a second removable gripping attachment extending along a tip of the intermediate jaw.

11. The vibratory apparatus according to claim 7, wherein the at least one gripping attachment further includes a second removable gripping attachment extending along a tip of the intermediate jaw.

12. The vibratory apparatus according to claim 8, wherein the at least one gripping attachment further includes a second removable gripping attachment extending along a tip of the intermediate jaw.

13. The vibratory apparatus according to claim 1, wherein the first and second outer jaws are pivotable about a common outer jaw axle, the intermediate jaw is pivotable about an intermediate jaw axle, the intermediate jaw axle being positioned between the outer jaw axle and an outer extremity of the outer jaws, the apparatus further comprises a cross-arm axle extending through the first and second outer jaws, and the cross-arm axle is connected by at least one cross arm to the intermediate jaw axle.

14. The vibratory apparatus according to claim 1, further comprising a second gripping attachment removably connected to the intermediate jaw tip, the second gripping attachment being adapted to abut against the elongated gripping attachment when the jaws are pivoted towards each other.

15. A vibratory apparatus for forcing members into and out of a material and for use with a device having at least one movable device arm movable towards and away from the material, the apparatus comprising:

an outer housing connected to the device arms;

a vibratable inner housing mounted in the outer housing and extending outwardly therefrom; and first and second outer jaws and an intermediate jaw, the outer jaws and the intermediate jaw being pivotally connected to the inner housing proximal opposed first and second side walls thereof, the outer jaws and the intermediate jaw being configured for pivotal movement towards and away from each other for holding at least one member therebetween and in abutment therewith, the outer jaws being spaced apart along the first side wall and having respective outer jaw tips defining a gap therebetween, the intermediate jaw being connected proximate the second side wall opposite the gap and having an intermediate jaw tip reaching within the gap when the jaws are pivoted towards each other, the vibratory apparatus comprising a longitudinal gripping attachment removably connected to the outer jaw tips so as to extend within said gap, the inner housing being selectively vibratable to cause the member to vibrate by abutment therewith and through contact with the outer and intermediate jaws to force the member into or out of the material, wherein the first and second outer jaws are pivotable about a common outer jaw axle, the intermediate jaw is pivotable about an intermediate jaw axle, the intermediate jaw axle being positioned between the outer jaw axle and an outer extremity of the outer jaws, the apparatus further comprises a cross-arm axle extending through the first and second outer jaws, and the cross-arm axle is connected by at least one cross arm to the intermediate jaw axle.

16. The vibratory apparatus according to claim 15, wherein the first outer, second outer and intermediate jaws have curved inner jaw walls.

17. The vibratory apparatus according to claim 15, wherein each of the first outer, second outer and intermediate jaws taper down towards a respective gripping end thereof.

18. The vibratory apparatus according to claim 15, further comprising a second gripping attachment removably connected to the intermediate jaw tip, the second gripping attachment being adapted to abut against the elongated gripping attachment when the jaws are pivoted towards each other.

* * * * *